US009000993B2

(12) United States Patent
Jeon et al.

(10) Patent No.: US 9,000,993 B2
(45) Date of Patent: Apr. 7, 2015

(54) ANTENNA FEEDING STRUCTURE AND ANTENNA

(71) Applicant: Radina Co., Ltd, Seoul (KR)

(72) Inventors: Sin-Hyung Jeon, Seoul (KR); Hyeng-Cheul Choi, Seoul (KR); Jae-Seok Lee, Seoul (KR); Oul Cho, Suwon-si (KR)

(73) Assignee: Radina Co., Ltd, Seoul (KR)

( * ) Notice: Subject to any disclaimer, the term of this patent is extended or adjusted under 35 U.S.C. 154(b) by 197 days.

(21) Appl. No.: 13/645,530

(22) Filed: Oct. 5, 2012

(65) Prior Publication Data

US 2013/0027260 A1 Jan. 31, 2013

Related U.S. Application Data

(63) Continuation of application No. PCT/KR2011/002420, filed on Apr. 6, 2011.

(30) Foreign Application Priority Data

Apr. 6, 2010 (KR) ..... 10-2010-0031243
May 7, 2010 (KR) ..... 10-2010-0042963
Apr. 6, 2011 (KR) ..... 10-2011-0031505

(51) Int. Cl.

*H01Q 9/00* (2006.01)
*H01Q 5/00* (2006.01)
*H01Q 7/00* (2006.01)
*H01Q 9/04* (2006.01)

(52) U.S. Cl.

CPC ..... *H01Q 5/0058* (2013.01); *H01Q 7/005* (2013.01); *H01Q 9/0421* (2013.01)

(58) Field of Classification Search

CPC . H01Q 5/0024; H01Q 5/0051; H01Q 5/0058; H01Q 9/0407; H01Q 9/0421; H01Q 1/243; H01Q 7/005
USPC ..... 343/749, 702, 745
See application file for complete search history.

(56) References Cited

U.S. PATENT DOCUMENTS 6,903,688 B2 * 6/2005 Edvardsson ..... 343/700 MS
2004/0087341 A1 5/2004 Edvardsson (Continued)

FOREIGN PATENT DOCUMENTS

CN 1484876 A 3/2004
JP 2005-210568 A 8/2005
KR 10-2003-0066779 A 8/2003

(Continued)

OTHER PUBLICATIONS

Korean Intllectual Property Office, International Search Report for PCT/KR2011/002420, mailed Aug. 29, 2011.

*Primary Examiner* — Hoang V Nguyen
(74) *Attorney, Agent, or Firm* — Park, Kim & Suh, LLC

(57) ABSTRACT

The disclosure provides an antenna feeding structure having a low frequency loop, an intermediate frequency loop, and a high frequency loop, and generates resonance between the inductance of the intermediate frequency loop itself and a capacitive element in the intermediate frequency loop, wherein the antenna feeding structure is configured to be able to adjust the resonance frequency using the area of the loop and the value of the capacitive element, thereby allowing the antenna to have a broadband characteristic, and further, making it possible to easily design an antenna having a desired band.

10 Claims, 9 Drawing Sheets

(56) References Cited

U.S. PATENT DOCUMENTS

| | | | |
|---|---|---|---|
| 2005/0162324 | A1 | 7/2005 | Sato et al. |
| 2009/0303133 | A1 | 12/2009 | Ueki |

FOREIGN PATENT DOCUMENTS

| | | | |
|---|---|---|---|
| KR | 10-2006-0097415 | A | 9/2006 |
| WO | WO2008-072411 | A | 6/2008 |

* cited by examiner

*-Related Art-*

*-Related Art-*

ANTENNA FEEDING STRUCTURE AND ANTENNA

CROSS REFERENCE TO PRIOR APPLICATIONS

This application is a Continuation Application of a PCT International Patent Application No. PCT/KR2011/002420 (filed on Apr. 6, 2011), which claims priority to Korean Patent Application Nos. 10-2010-0031243 (filed on Apr. 6, 2010), 10-2010-0042963 (filed on May 7, 2010), and 10-2011-0031505 (filed on Apr. 6, 2011), which are all hereby incorporated by reference in their entirety.

BACKGROUND

1. Technical Field

The present invention relates to an antenna, and more specifically, to a feeding structure for providing an RF signal radiated from an antenna and the antenna using the feeding structure.

2. Background Art

An antenna is an apparatus for receiving RF signals in the air inside a terminal and transmitting signals inside the terminal to outside, and it is an indispensable element in communicating with outside in a wireless device.

FIG. 1 is a view showing the configuration of an antenna according to a conventional technique. Referring to FIG. 1, the antenna 10 according to a conventional technique includes a feeding unit 11 and radiators 12*a* and 12*b*. In the antenna 10 according to a conventional technique, the feeding unit 11 is directly connected to the radiators 12*a* and 12*b*, and a signal provided by the feeding unit 11 is transmitted to outside through the radiators 12*a* and 12*b*. At this point, the ground of a wireless communication device may be used as the radiators 12*a* and 12*b*, or the radiators 12*a* and 12*b* may be configured as a separate radiator. Alternatively, a separate radiator can be used as one of the radiators 12*a*, and the ground can be used as the other radiator 12*b*.

In the antenna according to FIG. 1, since the feeding unit 11 directly provides electrical signals to the radiators 12*a* and 12*b* only in an electrical method without a separate feeding structure, performance of the antenna is lower than that of an antenna having a feeding structure.

FIG. 2 is a view showing an antenna having a feeding structure according to a conventional technique. Referring to FIG. 2, the antenna 20 according to a conventional technique includes a feeding unit 21, radiators 22*a* and 22*b*, and a conducting line 24 for forming a feeding loop 25.

The antenna 20 according to FIG. 2 forms the feeding loop 25 using the conducting line 24, and thus feeding can be performed by magnetic coupling other than electrical feeding. Therefore, performance of the antenna is improved compared with that of the antenna 10 in FIG. 1 that does not have a feeding loop 25. However, although an antenna has the feeding loop 25, performance is degraded in a high frequency domain. This will be described below in detail.

If RF current provided by the feeding unit 21 flows through the feeding loop 25, equivalent magnetic current is generated. The equivalent magnetic current $I_m$ is expressed as shown in mathematical expression 1.

$$I_m l = j\omega\mu S I(\omega) \quad \text{[Mathematical expression 1]}$$

In mathematical expression 1, $I_m l$ denotes equivalent magnetic current having length l, ω denotes an angular frequency of RF current, μ denotes permeability, S denotes an area of a feeding loop, and I(ω) denotes RF current provided by the feeding unit.

The equivalent magnetic current $I_m$ generated in the feeding loop 25 can be considered as magnetic flux generated in the feeding loop 25, and the magnetic flux generated in the feeding loop 25 and the equivalent magnetic current $I_m$ have a relation as shown in mathematical expression 2.

$$I_m = j\omega\psi \quad \text{[Mathematical expression 2]}$$

In mathematical expression 2, ψ denotes total magnetic flux generated in the feeding loop 25.

On the other hand, the total magnetic flux generated in the feeding loop 25 can be expressed as shown in mathematical expression 3.

[Mathematical expression 3]

$$\psi = \int \vec{B} \cdot \vec{ds} \approx B \cdot S = L \cdot I = L\frac{V}{R + j\omega L} \propto \frac{1}{\omega}$$

According to mathematical expression 3, it is understood that as the frequency of the RF current provided by the feeding unit 21 increases, the amount of total magnetic flux generated in the feeding loop 25 is decreased. That is, decrease in the amount of total magnetic flux generated in the feeding loop 25 means decrease in the equivalent magnetic current $I_m$. Accordingly, since the equivalent magnetic current $I_m$ decreases at a high frequency and thus RF signals cannot be efficiently fed to the radiators 22*a* and 22*b*, performance of the antenna shown in FIG. 3 is degraded at a high frequency, and thus the frequency band is narrowed.

Nevertheless, antennas of the conventional technique do not propose an efficient feeding structure for improving performance of an antenna, and it has been tried mainly to design an antenna having good characteristics by changing design of the radiator.

However, if the shape of a radiator is changed to be complex in order to improve characteristics of an antenna, manufacturing cost will be increased, and it is unable to correctly grasp which feature of an antenna is changed by which element of the radiator, and thus antenna design itself is getting further complicated and difficult.

SUMMARY OF THE INVENTION

Therefore, the present invention has been made in view of the above problems, and it is an object of the present invention to provide a feeding structure and an antenna using thereof, in which the antenna may operate as a broadband antenna while having a simple shape.

To accomplish the above object, according to one aspect of the present invention, there is provided an antenna feeding structure having a low frequency loop, an intermediate frequency loop and a high frequency loop, in which resonance is generated by inductance of a loop itself and a capacitive element in the intermediate loop, and the resonance frequency can be controlled using the area of the loop and a value of the capacitive element.

The antenna having a feeding structure according to the present invention has broadband characteristics while having a simple structure.

BRIEF DESCRIPTION OF THE DRAWINGS

FIG. 5(*b*) is a view showing a first embodiment of an antenna applying a feeding structure according to the present invention.

DETAILED DISCLOSURE OF THE INVENTION

The present invention includes a first loop containing a feeding unit and a capacitive element, a second loop containing the capacitive element and a conducting line directly connecting both ends of the capacitive element, and a third loop containing the feeding unit and the conducting line, and the resonance frequency of the second loop is preferably determined by the area of the second loop and a capacitance value of the capacitive element.

Figure 3:
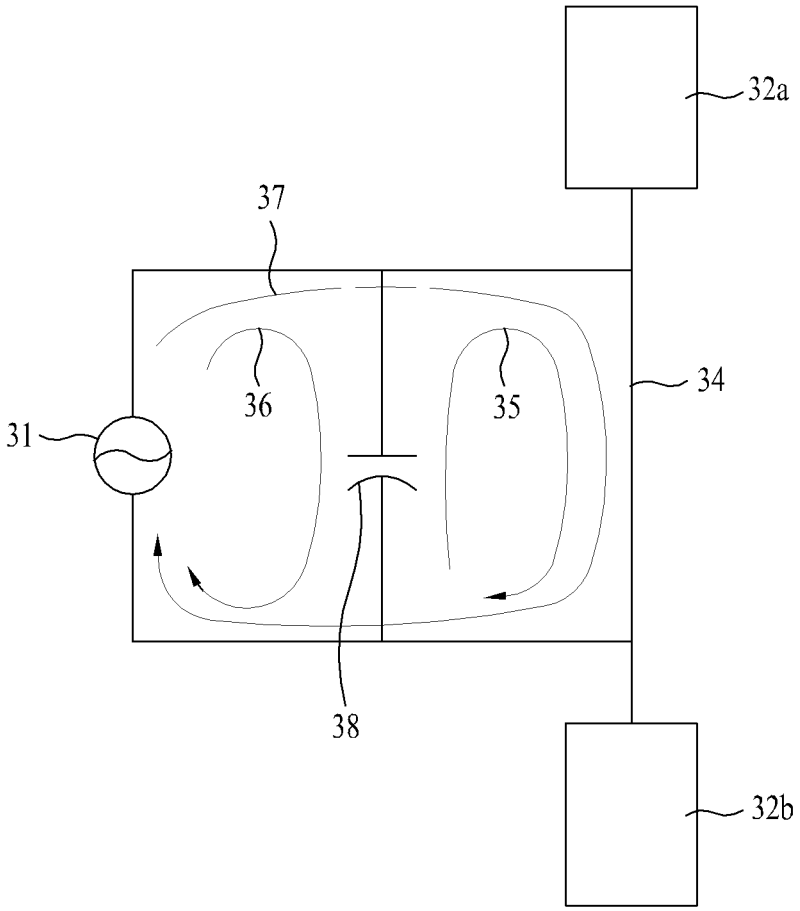
FIG. 3 is a view showing an antenna applying the feeding structure according to an embodiment of the present invention.

FIG. 3 is a view showing an antenna applying the feeding structure according to an embodiment of the present invention. As shown in FIG. 3, the antenna according to the present invention includes a feeding unit 31, radiators 32*a* and 32*b*, a first loop 36 containing the feeding unit 31 and a capacitive element 38, a second loop 35 containing the capacitive element 38 and a conducting line 34, and a third loop 37 containing the feeding unit 31 and the conducting line 34.

At this point, since each of the loops 36, 35 and 37 is a structure for feeding RF signals to the radiators 32*a* and 32*b*, it can be referred to as a feeding structure.

Operating principles of the antenna according to FIG. 3 are described below.

Since impedance toward the first loop 36 increases in a low frequency domain, current flows mainly toward the third loop 37, and magnetic flux generated mainly by the third loop 37 is provided to the radiators 32*a* and 32*b*.

In addition, since impedance toward the third loop 37 increases in a high frequency domain, current flows mainly toward the first loop 36, and magnetic flux generated mainly by the first loop is provided to the radiators 32*a* and 32*b*.

Meanwhile, in the intermediate frequency, resonance is generated by inductance provided by the second loop 35 of itself and capacitance provided by the capacitive element 38, and magnetic flux generated mainly by the resonance is provided to the radiators 32*a* and 32*b*.

As described above, since the antenna according to the present invention has three loops to generate strong magnetic flux in different frequency domains, broadband feeding can be performed as a result.

The resonance generated in the intermediate frequency domain is described below in detail.

First, a frequency which generates resonance can be expressed as shown in mathematical expression 4.

$$f = \frac{1}{2\pi\sqrt{L_f C}}$$ [Mathematical expression 4]

In mathematical expression 4, f denotes a resonance frequency, $L_f$ denotes inductance provided by a current loop, C denotes capacitance of the capacitive element 38.

Meanwhile, inductance provided by the current loop can be expressed as shown in mathematical expression 5.

$$L_f \approx \mu \times \sqrt{S}$$ [Mathematical expression 5]

In mathematical expression 5, μ denotes permeability, and S denotes the area of the current loop.

Accordingly, a frequency for generating resonance can be determined by adjusting the area of the second loop 35 corresponding to the current loop of the intermediate frequency domain and capacitance of the capacitive element 38.

As a result, if the feeding structure according to the present invention is applied, the antenna may have broadband characteristics, and the central frequency of a band can be adjusted, and thus the antenna may have broadband characteristics in a desired band.

Figure 4:
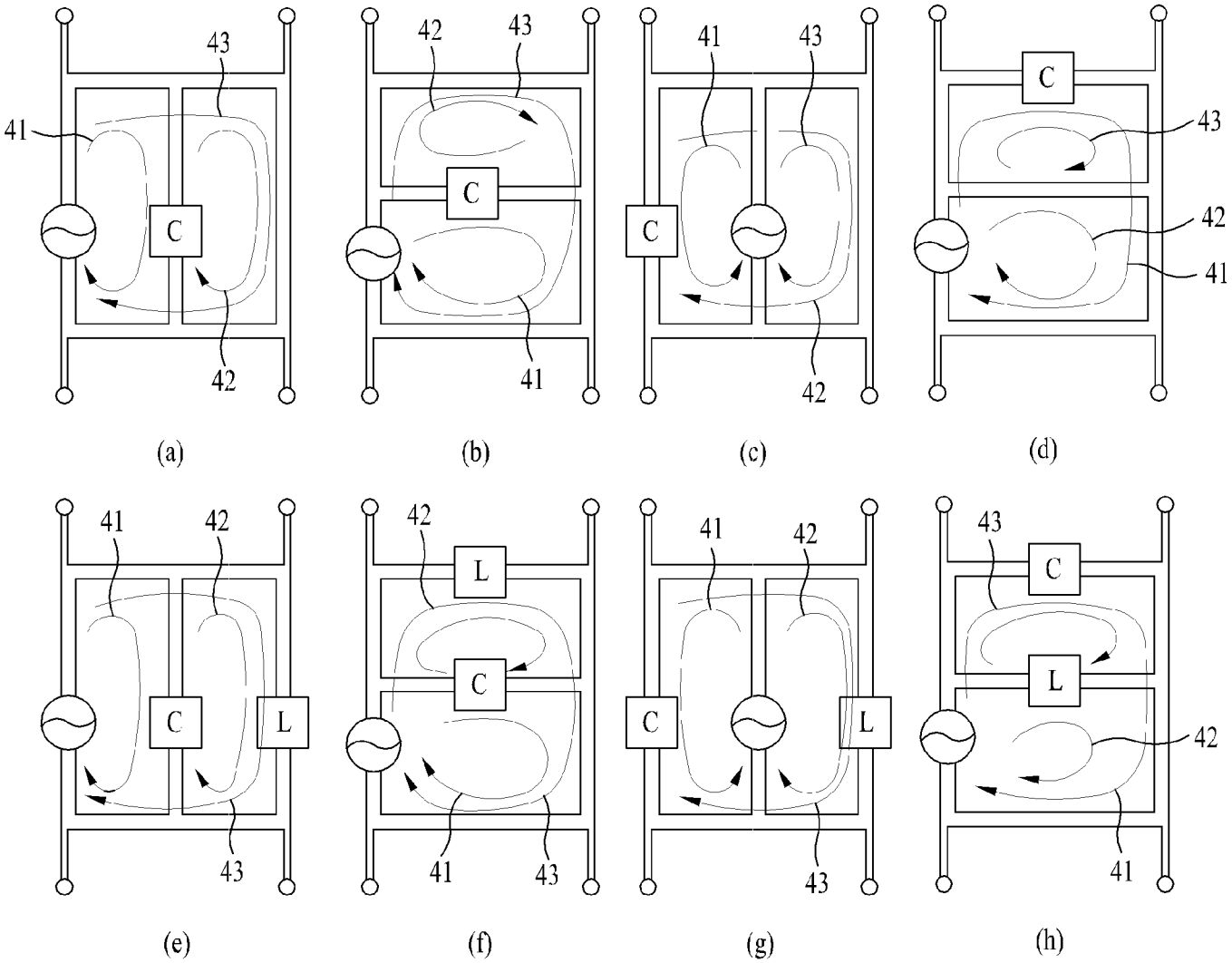
FIG. 4 is a view showing various embodiments of a feeding structure according to the present invention.

FIG. 4 is a view showing various embodiments of a feeding structure according to the present invention. Referring to FIG. 4, various shapes of feeding structures are shown, and all the feeding structures have the characteristics of the present invention described below.

That is, three loops are formed, and a first loop 41 is a loop corresponding to a high frequency and includes a feeding unit and a capacitive element. A second loop 42 is a loop corresponding to an intermediate frequency and includes the capacitive element and a conducting line (or an inductive element) connecting both ends of the capacitive element, and a third loop 43 is a loop corresponding to a low frequency and includes the feeding unit and the conducting line connecting both ends of the feeding unit.

Although examples that do not have a matching element connected to a feeding source are shown in FIG. 4, the matching element can be connected to the feeding source. At this point, the matching element is a lumped circuit element (an inductor or a capacitor) having a reactance component, and it is connected to the feeding source in series or parallel.

Meanwhile, the second loop 42 corresponding to the intermediate frequency should satisfy resonance conditions at a desired frequency, and inductance needed for satisfying the resonance conditions is provided only by a current loop or by the current loop and the lumped circuit element (an inductive element). At this point, inductance provided by the current loop is determined by the area of the second loop 42. Total inductance provided by the current loop and the inductive element is expressed as shown in mathematical expression 6.

$$L_{total} = L_f + L_{lump}$$ [Mathematical expression 6]

In mathematical expression 6, $L_{total}$ denotes total inductance, $L_f$ denotes inductance provided by a current loop, and $L_{lump}$ denotes inductance provided by the inductive element.

Accordingly, if inductance is provided by the lumped circuit element (inductive element), as well as by the current loop, mathematical expression 4 related to the resonance frequency can be expressed as shown in mathematical expression 7.

$$f = \frac{1}{2\pi\sqrt{L_{total}C}}$$ [Mathematical expression 7]

Figure 1:
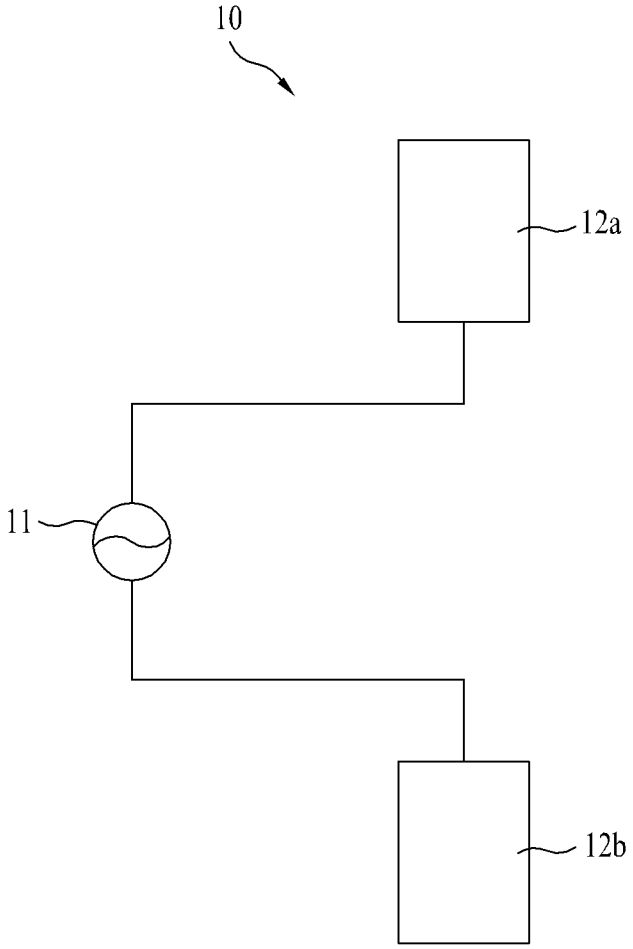
FIG. 1 is a view showing the configuration of an antenna according to a conventional technique.
Figure 2:
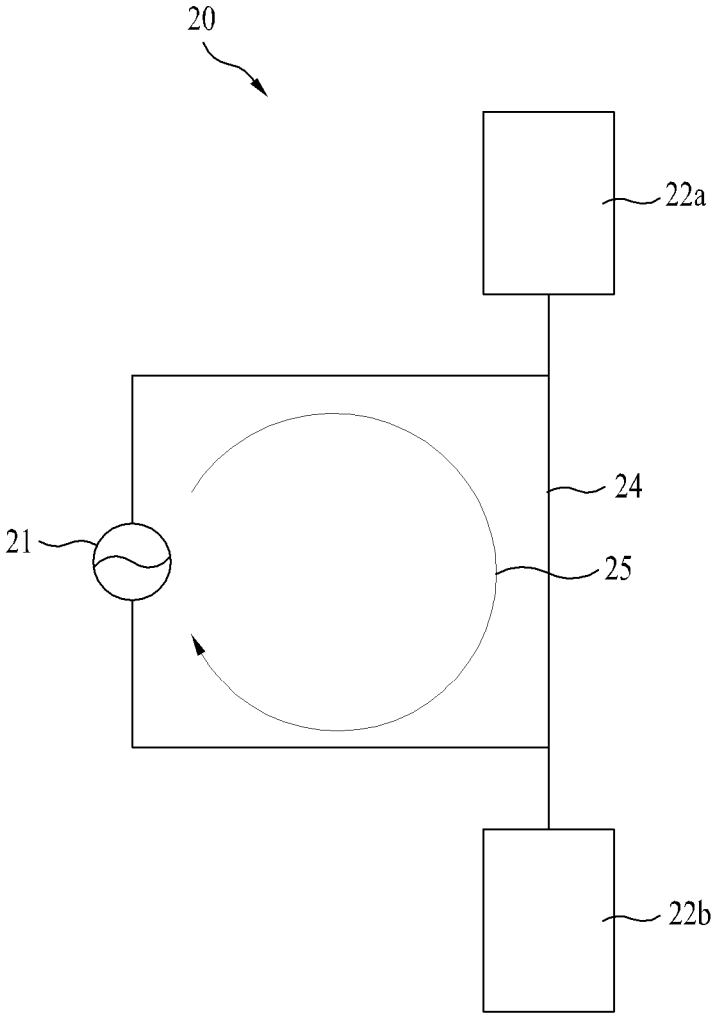
FIG. 2 is a view showing an antenna having a feeding structure according to a conventional technique.
Figure 5A:
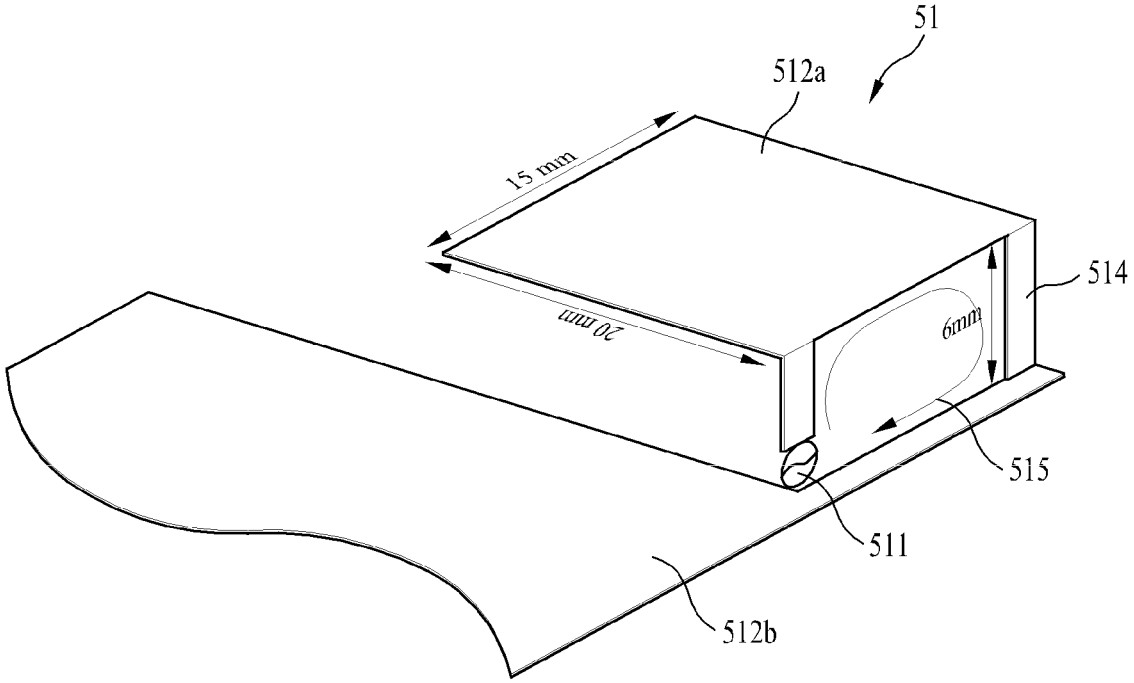
FIG. 5(*a*) is a view showing an example of an antenna applying a feeding structure according to a conventional technique.
Figure 5B:
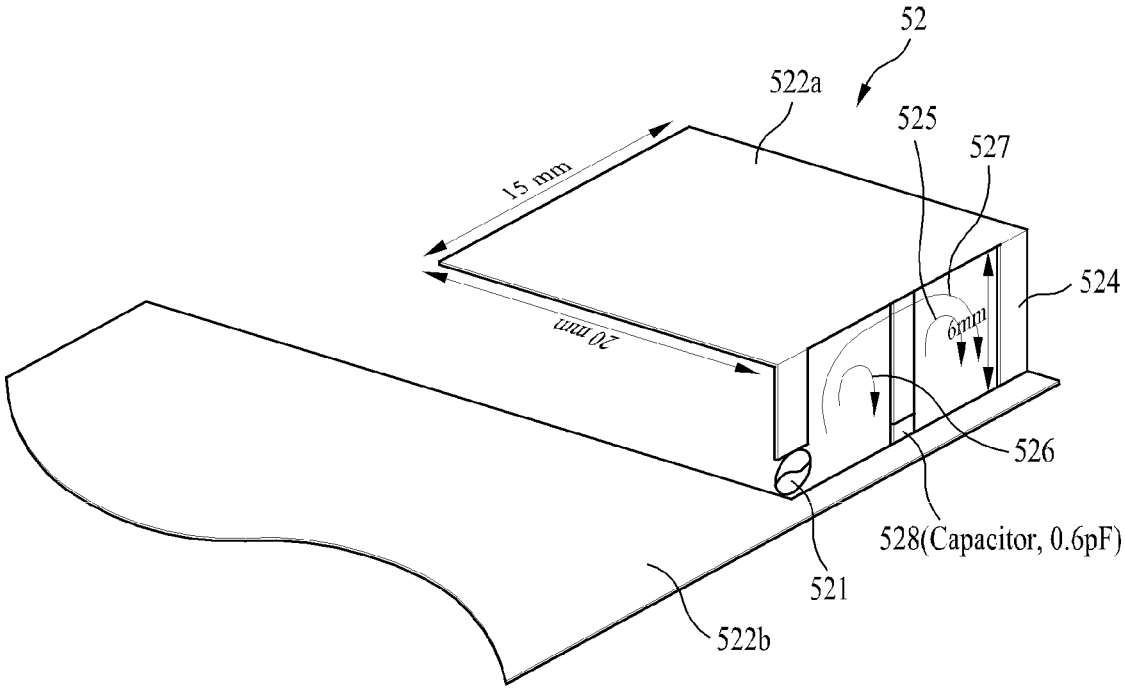

FIG. 5(*a*) is a view showing an example of an antenna applying a feeding structure according to a conventional technique. The antenna shown in FIG. 5(*a*) is an example of an antenna applying the feeding structure shown in FIG. 2.

The antenna applying the feeding structure according to the conventional technique includes a feeding unit 511, a radiator 512*a*, a ground plane 512*b* for providing a ground potential and operating as a radiator, and a conducting line 514 for forming a feeding loop 515.

FIG. 5(*b*) is a view showing a first embodiment of an antenna applying a feeding structure according to the present invention. The antenna shown in FIG. 5(*b*) is an example of an antenna applying the feeding structure shown in FIG. 4(*a*).

The antenna according to the embodiment includes a feeding unit 521, a radiator 522*a*, a ground plane 522*b* for providing a ground potential and operating as a radiator, a first loop 526 containing a feeding unit 521 and a capacitive element 528, a second loop 525 containing the capacitive element 528 and a conducting line 524, and a third loop 527 containing the feeding unit 521 and the conducting line 524.

At this point, since each of the loops 526, 525 and 527 is a structure for feeding RF signals to the radiators 522*a* and 522*b*, it can be referred to as a feeding structure.

A resonance frequency of an antenna having a feeding structure according to the present invention can be controlled in a method described below.

First, if inductance of the second loop is calculated for the antenna shown in FIG. 5(*b*) using mathematical expression 5, it will be as shown in mathematical expression 8.

$$L_f \approx \mu \times \sqrt{S} = 4\pi \times 10^{-7} \times \sqrt{5 \times 6 \times 10^{-6}} = 6.9 \text{ nH}$$ [Mathematical expression 8]

In addition, if the resonance frequency of the second loop is calculated using mathematical expression 4, it will be as shown in mathematical expression 9.

[Mathematical expression 9]

$$f_r = \frac{1}{2\pi \times \sqrt{0.6 \times 10^{-12} \times 6.9 \times 10^{-9}}} = 2.47 \text{ GHz}$$

Figure 6:
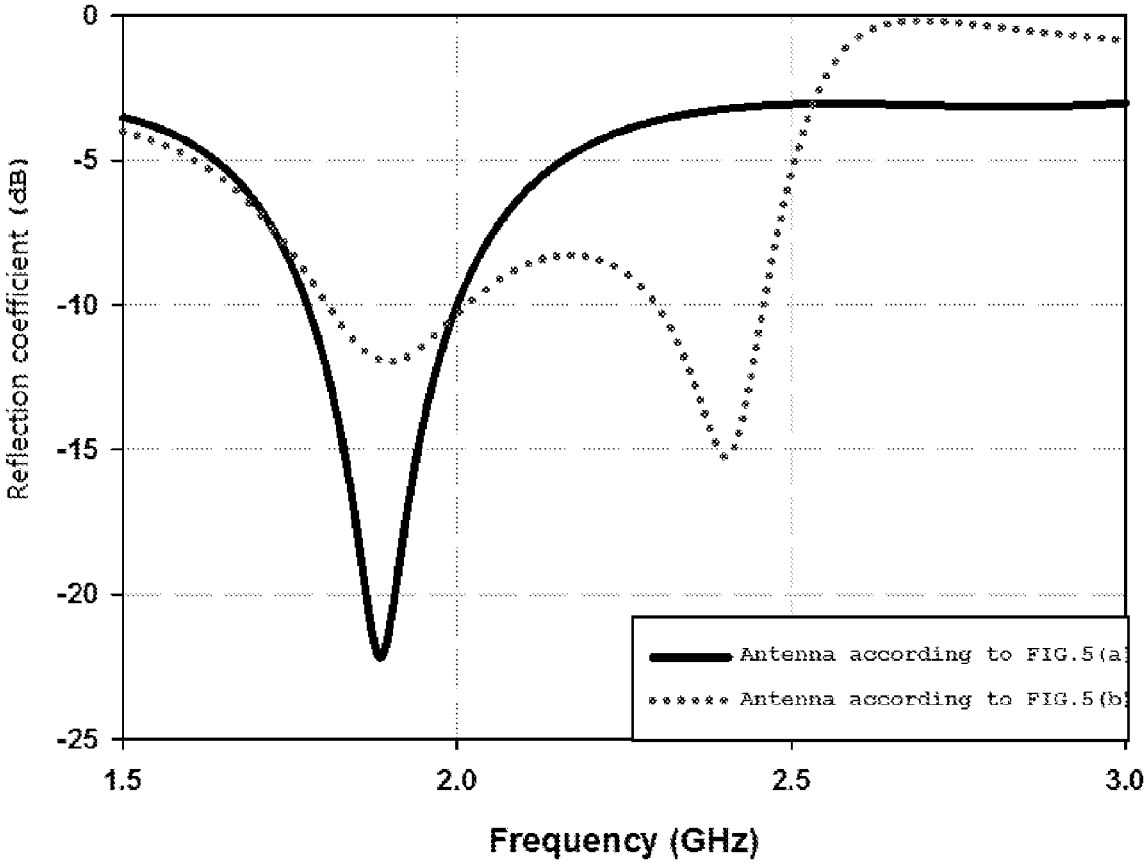
FIG. 6 is a view comparing characteristics of an antenna according to FIG. 5(*a*) and an antenna according to FIG. 5(*b*).

FIG. 6 is a view comparing characteristics of an antenna according to FIG. 5(*a*) and an antenna according to FIG. 5(*b*).

As shown in FIG. 6, it is understood that the antenna according to the present invention has broadband characteristics, compared with an antenna according to the conventional technique. In addition, resonance can be actually generated at a resonance frequency around 2.47 GHz that is calculated by mathematical expression 7. Accordingly, since an antenna having a feeding structure according to the present invention not only has broadband characteristics, but also controls the resonance frequency as needed, an antenna having a desired band can be easily designed. That is, an antenna having a desired band can be designed by changing the area of the second loop and capacitance of the capacitive element. In addition, if the inductance generated from the area of the second loop is small, an antenna having a desired band can be designed by adding an inductive element to the second loop.

Figure 7:
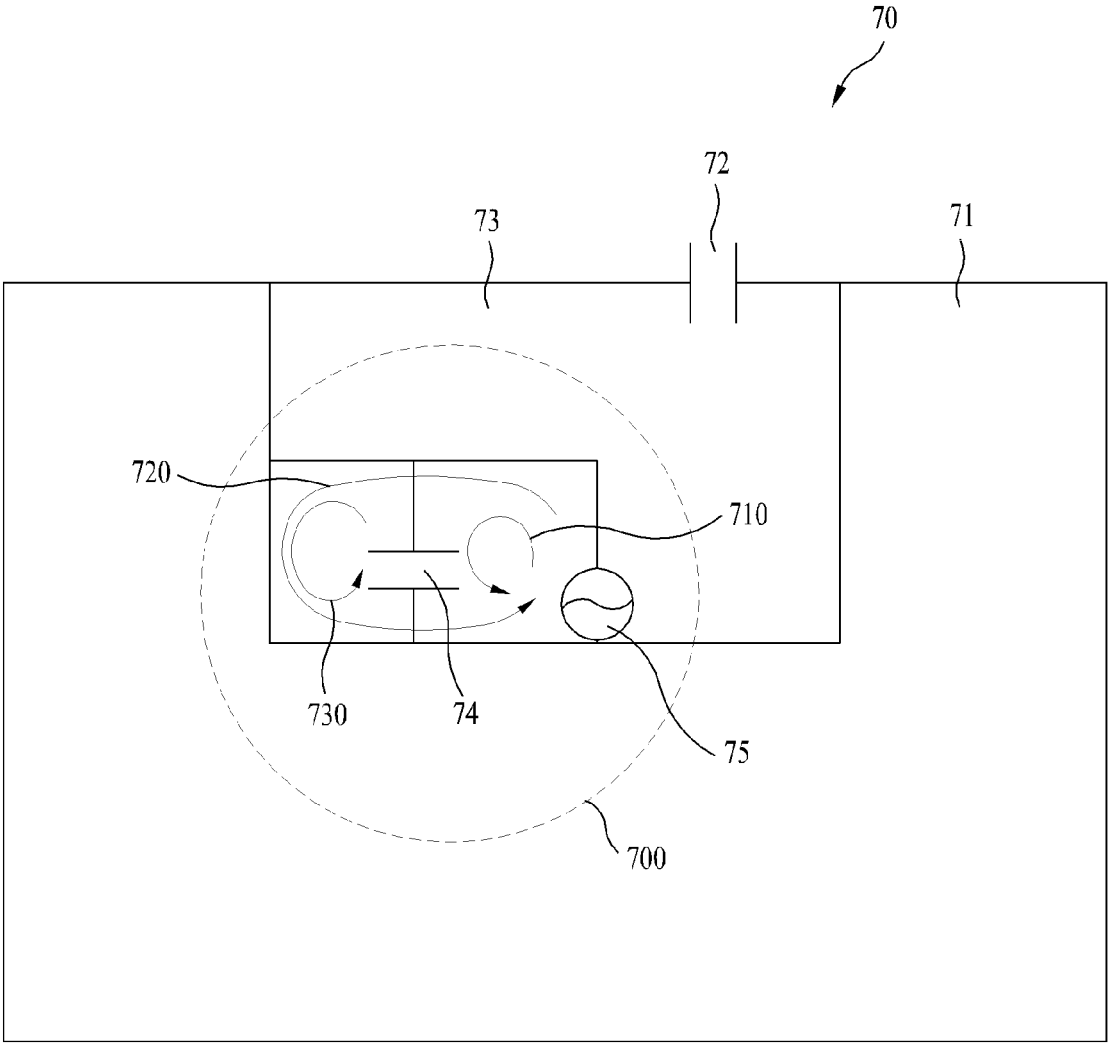
FIG. 7 is a view showing a second embodiment of an antenna applying a feeding structure according to the present invention.

FIG. 7 is a view showing a second embodiment of an antenna applying a feeding structure according to the present invention.

The antenna 70 according to the embodiment includes a ground 71 and a capacitor 72 operating as a radiator, a clearance 73 which is an area where the ground 71 is removed, and a feeding structure 700 formed inside the clearance 73.

Meanwhile, the feeding structure 700 includes a first loop 710, a second loop 730, and a third loop 720. The first loop 710 contains a feeding unit 75 and a capacitive element 74. Meanwhile, the second loop 730 contains the capacitive element and the ground 71 functioning as a conducting line. In addition, the third loop 720 contains the feeding unit 75 and the ground 71 functions as a conducting line.

The feeding structure 700 according to the embodiment also includes a third loop 720 corresponding to a low frequency loop, a second loop 730 corresponding to an intermediate frequency loop, and a first loop 710 corresponding to a high frequency loop, and a resonance frequency is determined by the area of the second loop 730 and capacitance of the capacitor 74.

Figure 8:
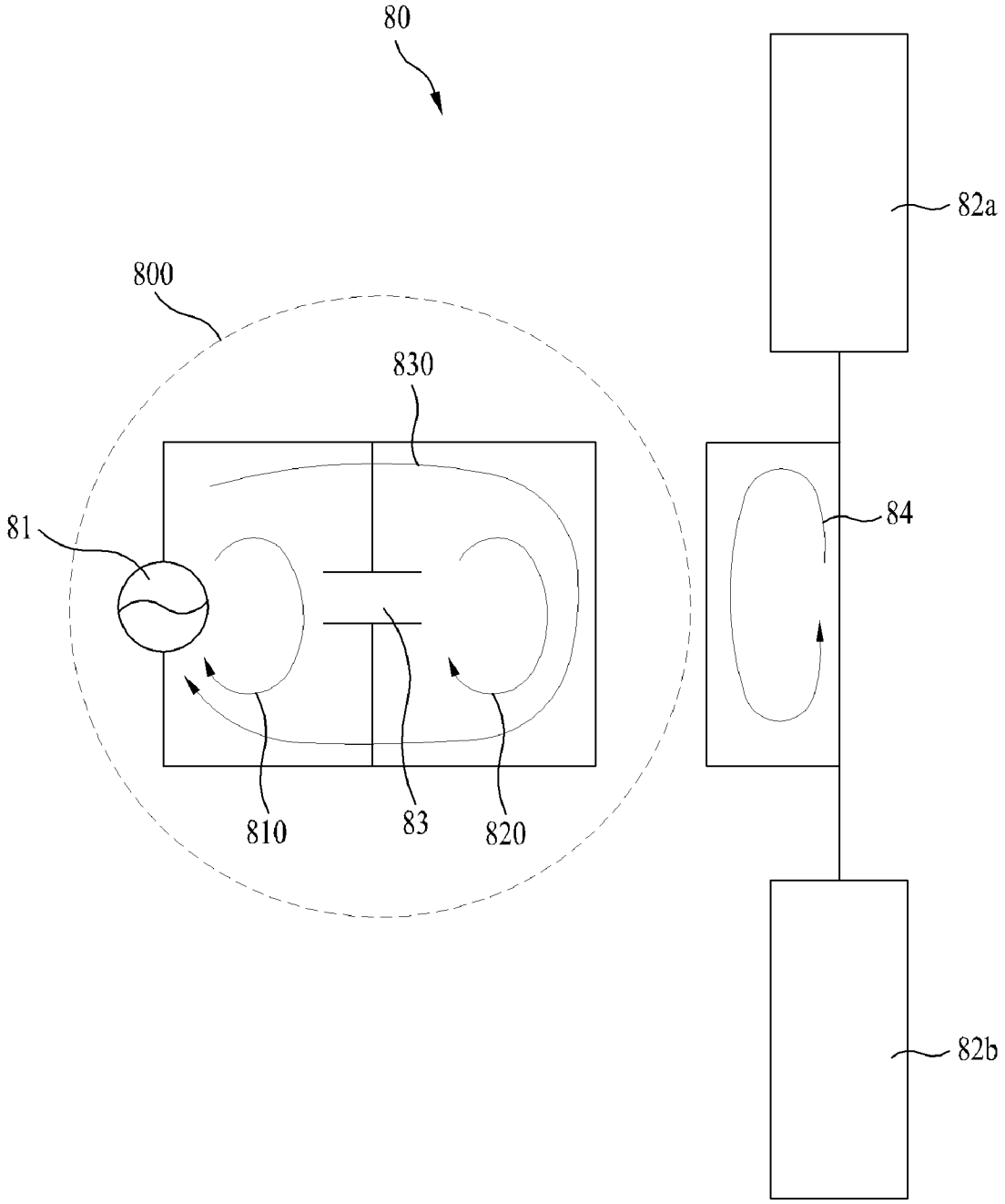
FIG. 8 is a view showing a third embodiment of an antenna applying a feeding structure according to the present invention.

FIG. 8 is a view showing a third embodiment of an antenna applying a feeding structure according to the present invention.

The antenna 80 according to the embodiment shows a case where radiators 82*a* and 82*b* are spaced apart from a feeding structure 800. That is, although the radiators 82*a* and 82*b* are spaced apart from the feeding structure 800, the radiators 82*a* and 82*b* (or a radiator loop 84 connected to the radiators 82*a* and 82*b*) and the feeding structure 800 are coupled by magnetic flux generated by the feeding structure 800. Accordingly, the feeding structure 800 may feed RF signals to the radiators 82*a* and 82*b* in an electromagnetic method.

The feeding structure 800 of the antenna 80 according to the embodiment includes a first loop 810 containing a feeding unit 81 and a capacitive element 83, a second loop 820 containing the capacitive element 83 and a conducting line, and a third loop 830 containing the feeding unit 81 and the conducting line.

The feeding structure 800 according to the embodiment also includes a third loop 830 corresponding to a low frequency loop, a second loop 820 corresponding to an intermediate frequency loop, and a first loop 810 corresponding to a high frequency loop, and a resonance frequency is determined by the area of the second loop 820 and capacitance of the capacitor 83.

Basically, the present invention relates to a feeding structure for further efficiently delivering RF signals inputted from a feeding unit to a radiator in an antenna structure including the feeding unit and the radiator. Accordingly, in describing the present invention, the feeding unit includes a feeding source and a matching circuit for impedance matching. For example, a reactance element for impedance matching can be connected to the feeding source, and in this case, the feeding source and the reactance element can be referred to as a feeding source.

Although an impedance matching circuit may be similar to the feeding structure of the present invention, it is apparent to those skilled in the art that this is only for impedance transformation, not a feeding structure for excitation of an antenna radiator. That is, the present invention relates to a feeding structure capable of controlling characteristics of an antenna further easily by adjusting an area of a loop and capacitance of a capacitor included in the loop.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The present invention can be used for an antenna of a wireless communication device.

The invention claimed is:

1. An antenna feeding structure for excitation of an antenna radiator, the structure comprising:

a first loop containing a feeding unit and a capacitive element;

a second loop containing the capacitive element and a conducting line directly connecting both ends of the capacitive element; and a third loop containing the feeding unit and the conducting line, wherein a resonance frequency of the second loop is controlled by an area of the second loop and a capacitance value of the capacitive element, and the area of the second loop and the capacitance value are selected such that the resonance frequency of the second loop is within a desired frequency band.

2. The structure according to claim 1, wherein an inductance value for forming the resonance frequency is determined depending on the area of the second loop.

3. The structure according to claim 1, wherein the first loop operates as a high frequency current loop.

4. The antenna according to claim 1, wherein the third loop operates as a low frequency current loop.

5. An antenna feeding structure for excitation of an antenna radiator, the structure comprising:

a first loop containing a feeding unit and a capacitive element;

a second loop containing the capacitive element and an inductive element connected to both ends of the capacitive element; and a third loop containing the feeding unit and a conducting line, wherein a resonance frequency of the second loop is controlled by an area of the second loop, an inductance value of the inductive element and a capacitance value of the capacitive element, and the area of the second loop, the inductance value, and the capacitance value are selected such that the resonance frequency of the second loop is within a desired frequency band.

6. The structure according to claim 5, wherein the inductance for resonance in the second loop is determined by the area of the second loop and the inductance value of the inductive element.

7. The structure according to claim 5, wherein the first loop operates as a high frequency current loop.

8. The structure according to claim 5, wherein the third loop operates as a low frequency current loop.

9. An antenna having an antenna feeding structure for excitation of an antenna radiator, the antenna comprising:

a feeding unit;

the antenna radiator; and the antenna feeding structure, wherein the antenna feeding structure includes:

a first loop containing the feeding unit and a capacitive element;

a second loop containing the capacitive element and a conducting line directly connecting both ends of the capacitive element; and a third loop containing the feeding unit and the conducting line, wherein a band of the antenna is controlled by an area of the second loop, wherein the area of the second loop and a capacitance value of the capacitive element are selected such that a resonance frequency of the second loop is within a desired frequency band of the antenna.

10. The antenna according to claim 9, wherein the band of the antenna is controlled by inductance corresponding to the area of the second loop and a resonance frequency corresponding to a capacitance value of the capacitive element.

* * * * *